US008353414B2

(12) United States Patent
Luzzato et al.

(10) Patent No.: US 8,353,414 B2
(45) Date of Patent: Jan. 15, 2013

(54) SNAP-SHUT STOPPER HAVING A PROJECTING TAB FOR A CONTAINER NECK

(75) Inventors: Michel Luzzato, Ecully (FR); Jérôme Mezerette, Saint Didier Au Mont d'Or (FR)

(73) Assignee: Tetra Laval Holdings & Finance S.A., Pully (CH)

( * ) Notice: Subject to any disclaimer, the term of this patent is extended or adjusted under 35 U.S.C. 154(b) by 153 days.

(21) Appl. No.: 12/994,632

(22) PCT Filed: May 25, 2009

(86) PCT No.: PCT/FR2009/050957

§ 371 (c)(1),
(2), (4) Date: Dec. 1, 2010

(87) PCT Pub. No.: WO2009/153487

PCT Pub. Date: Dec. 23, 2009

(65) Prior Publication Data

US 2011/0068079 A1 Mar. 24, 2011

(30) Foreign Application Priority Data

May 26, 2008 (FR) ..... 08 53407

(51) Int. Cl.
*B65D 41/48* (2006.01)
*B65D 55/02* (2006.01)
*B65D 39/00* (2006.01)

(52) U.S. Cl. ..... 215/253; 215/224; 215/364; 215/41

(58) Field of Classification Search ..... 215/253, 215/250, 317, 316, 320, 45, 43, 224, 201, 215/258, 355; 220/268, 266, 269, 265, 791, 789, 780, 782, 793; 222/541.6, 541.1; *B65D 41/48, 41/46, 41/32, 55/02, 39/00*

See application file for complete search history.

(56) References Cited

U.S. PATENT DOCUMENTS

| | | | | |
|---|---|---|---|---|
| 3,583,591 | A * | 6/1971 | Hayashida | 215/316 |
| 3,825,144 | A | 7/1974 | Wiedmer | |
| 4,429,800 | A * | 2/1984 | Greenspan | 215/216 |
| 4,919,286 | A * | 4/1990 | Agbay, Sr. | 215/235 |
| 5,423,441 | A * | 6/1995 | Conti | 215/225 |
| 5,540,349 | A * | 7/1996 | Philips | 220/780 |

FOREIGN PATENT DOCUMENTS

| | | |
|---|---|---|
| FR | 1206589 | 2/1960 |
| FR | 1484391 | 6/1967 |
| NL | 7214055 | 5/1973 |

* cited by examiner

*Primary Examiner* — Mickey Yu
*Assistant Examiner* — Robert J Hicks
(74) *Attorney, Agent, or Firm* — Finnegan, Henderson, Farabow, Garrett & Dunner, LLP

(57) ABSTRACT

A stopper for a container neck having a skirt centered on an axis, and an internal snapping device. The snapping device fastens the stopper to the neck by engaging with an edge of the neck and an external disengagement tab projecting outwards from the skirt and running over a peripheral portion of the skirt. The skirt includes an external collar projecting outwards and running over a peripheral portion of the skirt distinct from the portion associated with the tab, by being separated from the portion associated with the tab at either end around the periphery of the skirt. At least a portion of the collar that runs through greater than 180° about the axis includes, in cross-section relative to the axis, a circular outside profile centered on the axis and having a radius substantially equal to the maximum radial distance between the axis and the outside profile of the tab.

11 Claims, 3 Drawing Sheets

SNAP-SHUT STOPPER HAVING A PROJECTING TAB FOR A CONTAINER NECK

The present invention relates to a stopper for a container neck. The invention relates more particularly to "snap-shut" or "snap-on" stoppers, i.e. to a stopper having a tubular skirt suitable for being internally snapped removably around the neck of a container, unlike screw stoppers, for example.

This type of stopper, an example of which is given by FR-A-1 484 391, frequently has a tab that projects outwards from the skirt, so that the user can apply a manual drive force to the tab with a view to unsnapping the stopper. In practice, the extent and the angular position of the tab around the periphery of the skirt are advantageously predetermined as a function of other characteristics of the stopper that are related to opening it. For example, by making provision for the tab to extend over at least one quarter of a circle about the central axis of the skirt, on the front of the stopper, i.e. on the side designed to face the user when the stopper is in service, the user then intuitively understands that the stopper is to be tipped backwards by means of the tab. It is then possible to facilitate this tipping by providing a hinge-forming link at the back of the stopper, between a non-removable skirt portion that is retained around the neck, and a removable skirt portion that carries the tab externally and that is snapped/unsnapped relative to an end edge of the neck. It is also possible to limit the breaking strength between the removable and the non-removable skirt portions on the front of the skirt only, i.e. in the same portion as the tab.

In any event, it can be understood that having a tab that is clearly visible for the attention of the user constitutes a genuine advantage, and, to achieve this, it is necessary for the tab to occupy only a small peripheral portion of the skirt and to project clearly outwards from said skirt. However, the presence of such a tab poses a problem for putting the stopper in place on the neck of the container: the presence of the tab significantly limits the strength with which the stopper can be held by holder heads used to take hold of stoppers on bottling lines. Said heads take hold of the stoppers one by one around the outside peripheries of their skirts, so as to engage them by force onto the necks of the containers. Due to the tabs, the heads tend to take hold of the stoppers in skewed manner, and, above all, they are incapable of centering them accurately on the necks of the containers prior to engaging them by force, because the presence of the tab "artificially" shifts the position of the central axis of the head relative to the central axis of the skirt. The quality of the bottling is therefore compromised.

That problem is accentuated for stoppers in which the total height is relatively small because the skirt of such a stopper cannot be taken hold of directly under the tab, i.e. on that side of the tab that normally faces towards the container neck, e.g. by clamps or analogous machines.

An object of the present invention is to propose a snap-shut stopper provided with a tab and of the same type as mentioned above that can be put in place accurately and effectively by bottling heads that are in common use.

To this end, the invention provides a stopper for a container neck as defined in claim 1.

The basic idea of the invention is to make provision for the tab to continue to be clearly visible for the attention of the user, while also providing the skirt with a collar suitable for being taken hold of by a bottling head in common use, the collar being dimensioned to center the skirt accurately in said head. For this purpose, in accordance with the invention, the circular outline of the collar runs over more than one half-circle about the central axis of the skirt, thereby procuring a bearing surface for being taken hold of that is sufficient for bottling heads, while, at the same time, said collar has a radial dimension relative to the central axis of the skirt that is equal to the maximum radial dimension of the tab, thereby enabling the collar to compensate for the transverse shift in the position of the axis of the head that is caused by the presence of the tab. In other words, when the skirt has a cross-section that is of circular outside profile, the collar extends radially relative to the skirt to an extent equal to the maximum radial extent of the tab. When the holding head takes hold of the stopper of the invention, by surrounding it and clamping it via its collar and via its tab, the head is centered accurately on the central axis of the skirt, so that the stopper can then be snapped effectively by being engaged by force onto the container neck.

Other advantageous characteristics of the stopper of the invention, taken in isolation or in any technically feasible combination, are specified in dependent claims 2 to 10.

The invention can be better understood on reading the following description given merely by way of example and with reference to the accompanying drawings, in which.

Figure 1:
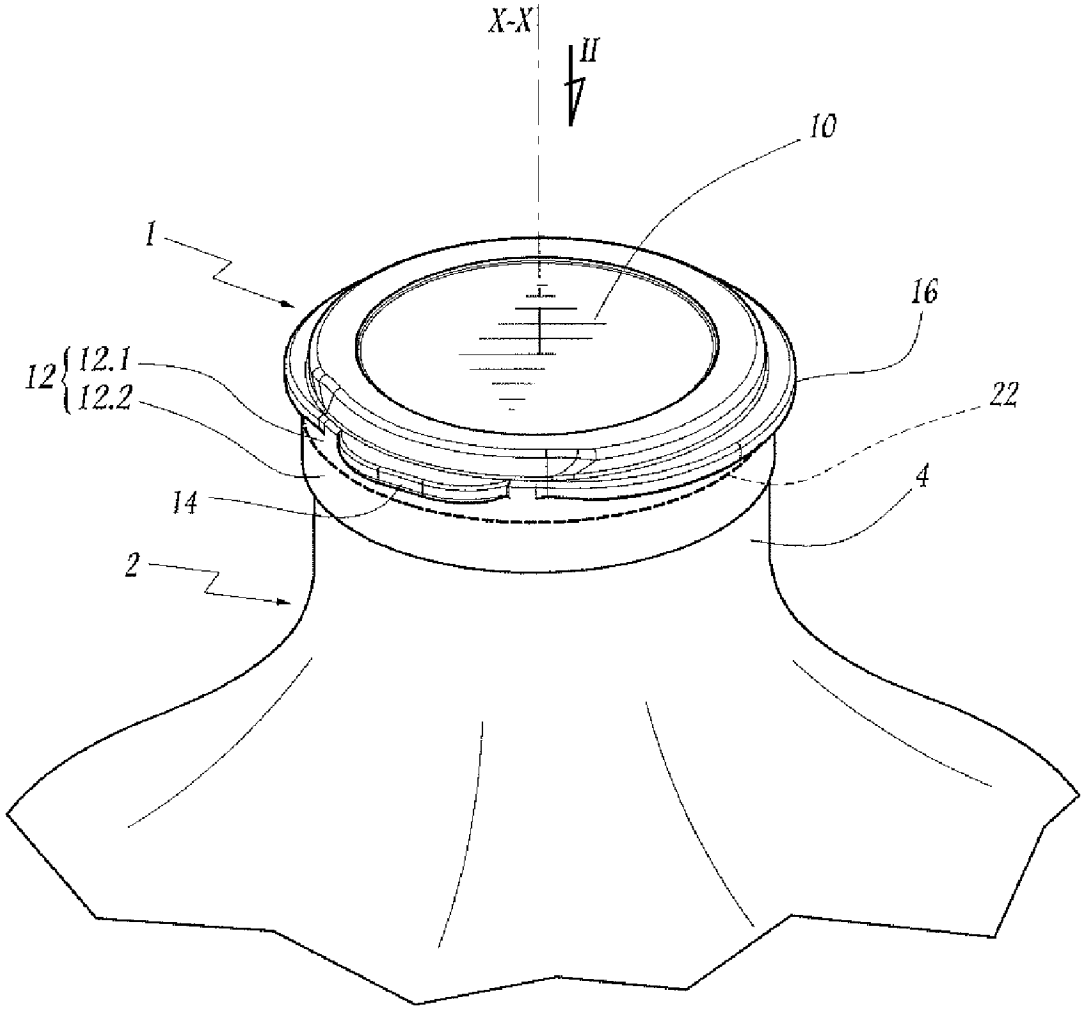
FIG. 1 is a perspective view of a stopper of the invention, as put in place around a container neck.

FIGS. 1 to 4 show a stopper 1 adapted to being fastened removably to a neck 2 of a container by snap-fastening. The stopper 1 may generally be referred to as a "snap-shut" stopper or as a "snap-on" stopper. In practice, the neck 2 is either formed integrally with the remainder of the container, in particular when said container is a bottle made of glass or of a plastics material, as shown in FIG. 1, or else it is adapted to being secured permanently to a wall of the container, at a through opening in said wall.

The stopper 1 and the neck 2 have respective shapes that are substantially tubular, and that have central longitudinal axes that substantially coincide with each other, as indicated by the reference X-X, when the stopper is fastened to the neck. For reasons of convenience, the description below considers that the terms "top" and "upwards" correspond to a direction that is substantially parallel to the axis X-X and that goes from the body of the container towards its neck 2, i.e. to a direction going towards the tops of FIGS. 1, 3, and 4, whereas the terms "bottom" and "downwards" correspond to the opposite direction.

The neck 2 has a body 4 that is substantially cylindrical with the cylindrical shape having a circular base and being of axis X-X. At its top end, the body 4 defines a rim 3 at which the liquid contained in the container is poured out, as shown in the chain dotted lines in the right portions only of FIGS. 3 and 4. On the outside face of the body 4, the neck 2 is provided, at its top end, with an edge 5, and, in its main portion, with a projection 6, both the edge and the projection extending radially outwards from the body.

The stopper 1 is made of a semi-rigid plastics material, such as polypropylene or polyethylene, shaped by molding.

The stopper 1, as considered snapped onto the neck 2, is open at its bottom end and is closed at its top end by an end-wall 10, at the outside periphery of which a tubular skirt 12 extends axially downwards, which skirt is centered on the axis X-X and, in this example, is of substantially annular section, with the annular section shape having a circular base.

When the stopper is snapped onto the neck, the end-wall 10 extends above and across said neck, while the skirt 12 surrounds the body 4 externally.

At its top end, the skirt 12 is provided with an external tab 14 that extends radially outwards from the cylindrical outside side face 12A of the skirt. Around the outside periphery of the skirt, this tab 14 runs over only a small peripheral portion $\mathbf{12}_1$ of the skirt 12, which portion is considered below as the front of the stopper 1, insofar as it is the side of the stopper that is designed to face the user when the stopper is in service. In practice, insofar as the tab 14 is designed to constitute a clearly visible marker on the front of the stopper 1 for the attention of the user and showing the user where to open the stopper, the portion $\mathbf{12}_1$ extends through a non-negligible angle that is, in practice, greater than at least a few degrees, and less than 90°. In the example shown in the figures, the portion $\mathbf{12}_1$ extends through about 50°.

Over the outside periphery of the skirt 12, the tab 14 firstly has a main portion $\mathbf{14}_1$ over which the outside profile, in cross-section relative to the axis X-X, is rectilinear in a direction that is circumferential to the axis X-X, and secondly has two end portions $\mathbf{14}_2$ over each of which the outside profile, in cross-section relative to the axis X-X, is curved in a manner such as to connect up to the main portion $\mathbf{14}_1$ at the outside face 12A of the skirt 12 by the extent to which the tab 14 extends radially relative to said face 12A decreasing progressively. Thus, in cross-section relative to the axis X-X, the radial distance between said axis and the outside profile of the tab 14 has two maximum values, referenced $R_{14}$ in FIG. 2 and situated at respective ones of the two link zones where the main portion $\mathbf{14}_1$ meets the two end zones $\mathbf{14}_2$.

Figure 2:
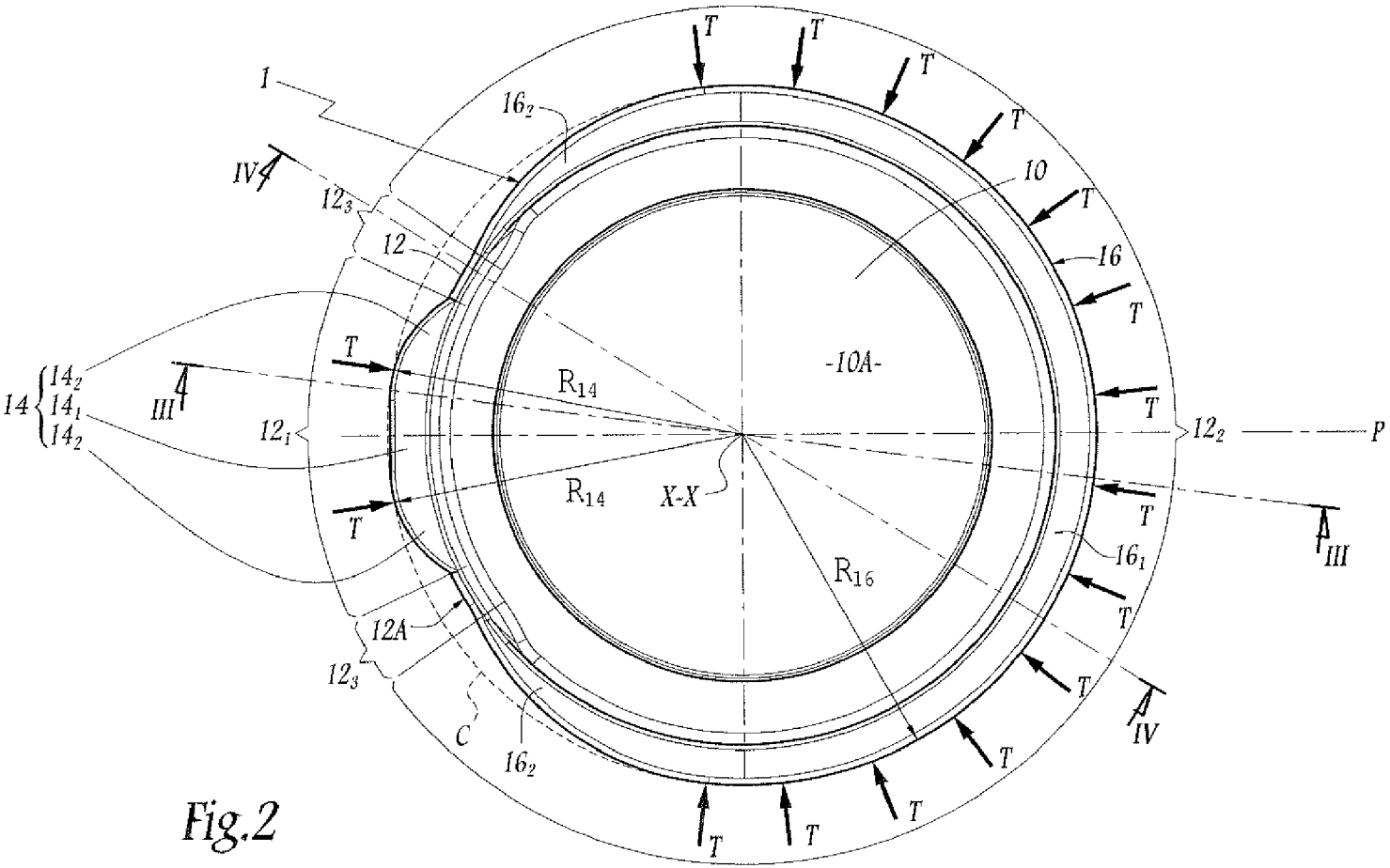
FIG. 2 is a plan view seen looking along the arrow II of FIG. 1.

In practice, in the example shown herein, the tab 14 has a plane of symmetry P that contains the axis X-X as can be seen clearly in FIG. 2.

At the same level along the axis X-X as the tab 14, the skirt 12 is provided with an external collar 16 that projects radially outwards from the face 12A, over only a peripheral portion $\mathbf{12}_2$ of the skirt. The extent to which the portion $\mathbf{12}_2$ extends peripherally is strictly greater than the extent to which the portion $\mathbf{12}_1$ extends peripherally, while nevertheless being limited by the fact that the portions $\mathbf{12}_1$ and $\mathbf{12}_2$ must be distinct from each other around the periphery of the skirt 12. In other words, around said periphery, the portions $\mathbf{12}_1$ and $\mathbf{12}_2$ do not overlap and are separated from each other by two peripheral portions $\mathbf{12}_3$ that are situated at respective ends of the portions $\mathbf{12}_1$ and $\mathbf{12}_2$ around the periphery of the skirt and that, between the tab and the collar, are free of any element projecting from the face 12A.

As specified below, the portion $\mathbf{12}_2$ of the collar 16 must extend through more than 180°. At the same time, the portions $\mathbf{12}_3$ must extend sufficiently for it to be easy for the user to distinguish visually between the tab 14 and the collar 16 around the periphery of the skirt 12, so that each portion $\mathbf{12}_3$ extends through at least 5° about the axis X-X. Thus, in the embodiment shown in the figures, the portion $\mathbf{12}_2$ extends through about 290° while each portion $\mathbf{12}_3$ extends through about 10°, it also being noted that, in this example, the plane P forms a plane of symmetry for the collar 16.

As clearly visible in FIG. 2, and around the periphery of the skirt, the collar 16 firstly has a main portion $\mathbf{16}_1$ over which the outside profile, in cross-section relative to the axis X-X, is circular and centered on said axis, and secondly has two end portions $\mathbf{16}_2$ over each of which the outside profile, in cross-section relative to the axis X-X, is curved in a manner such as to connect up to the main portion $\mathbf{16}_1$ at the outside face 12A of the skirt 12 by the extent to which the collar extends radially relative to said face 12A decreasing progressively. The main portion $\mathbf{16}_1$ constitutes most of the collar 16, in the sense that said main portion $\mathbf{16}_1$ runs through greater than 180° about the axis X-X, and preferably through about 200°, as in the example shown in the figures.

The circular outside profile of the portion $\mathbf{16}_1$ of the collar 16 has a radius $R_{16}$ that, ignoring molding clearance, is equal to the radial distance $R_{14}$ associated with the tab 14.

Figure 3:
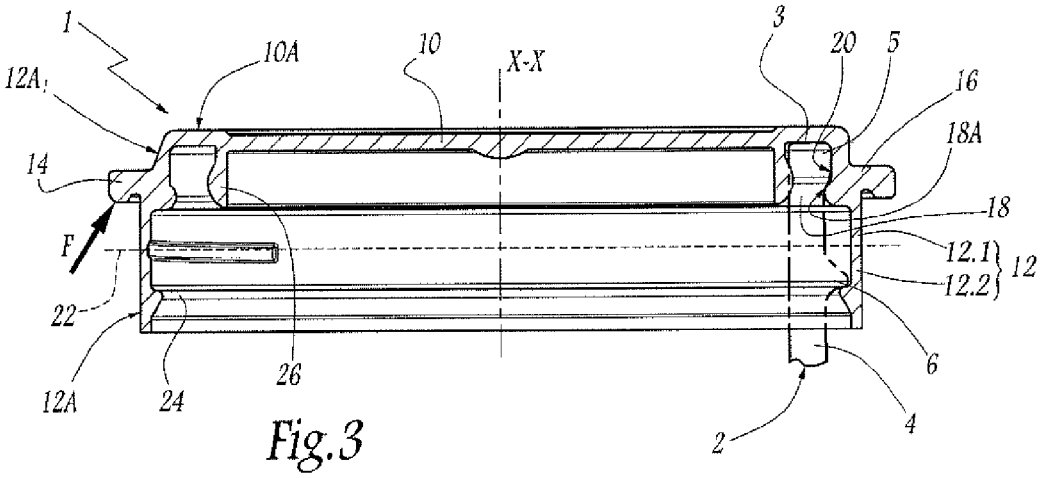
FIG. 3 and FIG. 4 are longitudinal section views of the stopper before it is put in place around the container neck, respectively on lines III-III and IV-IV of FIG. 2.
Figure 4:
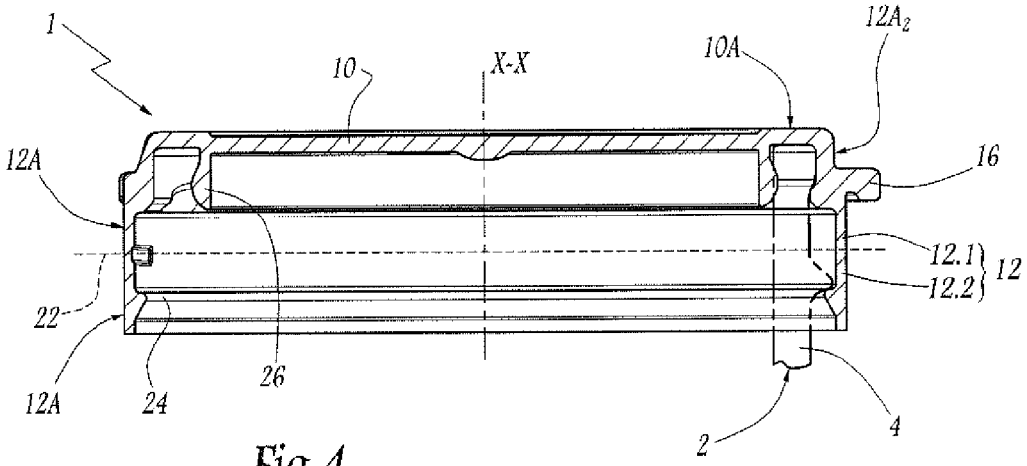

In order to reinforce the visual distinction between the tab 14 and the collar 16 for the attention of the user, the respective portions of the skirt 12 that connect the end wall 10 respectively to the tab and to the collar have different respective outside surfaces $\mathbf{12}A_1$ and $\mathbf{12}A_2$: the surface $\mathbf{12}A_2$ corresponds to a portion of a cylinder having a circular base and centered on the axis X-X, and it connects up to the plane top surface 10A of the end wall 10 in angular manner, substantially at right angles, as clearly visible in the right portions of FIGS. 3 and 4, while the surface $\mathbf{12}A_1$ corresponds to a portion of a truncated cone centered on the axis X-X and converging towards the end wall 10, thereby connecting the tab 14 to the surface 10A at a flatter angle than the surface $\mathbf{12}A_2$, as can be seen clearly in the left portion of FIG. 3. The fact that, externally, the portion of skirt connecting the tab 14 to the end wall 10 is, as it were, beveled or chamfered compared with the skirt portion connecting the collar 16 to said end wall, makes it possible to clear away some material and to vacate the space above the tab 14, thereby improving the extent to which said tab is visible for the attention of the user.

Advantageously, as in the embodiment considered in the figures, the flatter-angle surface $\mathbf{12}A_1$ is extended on either side of the portion $\mathbf{12}_1$, around the outside periphery of the skirt 12, at the portions $\mathbf{12}_3$ so as to connect up progressively to the cylindrical surface $\mathbf{12}A_2$.

In the top portion of the skirt 12, at about the same axial level as the tab 14, the skirt is internally provided with a snapping band 18 that is in the form of a bulge of material that extends radially inwards from the wall of the skirt. In longitudinal section through the stopper 1, this snapping band 18 has a convex surface 18A that is connected to the end-wall 10 while forming a recess 20 for receiving the edge 5 of the neck 2 in complementary manner. Thus, snapping the stopper consists in engaging said convex surface 18A with the bottom end of the edge 5, which edge is then received in the recess 20, and the end wall 10 is then pressed against the rim 3, as shown in the right portions of FIGS. 3 and 4. Conversely, unsnapping the stopper consists in disengaging the band 18 and the edge 5, by starting this disengagement on the front of the stopper 1, by acting on the tab 14, in particular by exerting on said tab a force F that is directed upwards in a direction parallel to the axis X-X or, more frequently inclined slightly relative to said axis, as indicated in FIG. 3.

In order to facilitate starting the unsnapping of the band 18, said band does not run continuously around the entire inside periphery of the skirt 12, but rather it is advantageously interrupted at least at the portions $\mathbf{12}_3$, as clearly visible in the left portion of FIG. 4.

When the stopper 1 is unsnapped for the first time, the skirt 12 is adapted to separate into two distinct portions, namely a top portion 12.1, formed integrally with the end-wall 10, and a bottom portion 12.2, initially connected to the top portion 12.1 by a peripheral line of weakness 22 situated axially in the main portion of the skirt and represented diagrammatically in the figures by a dashed line. The skirt portion 12.1 is designed to be disengaged from the neck 2 so that said portion 12.1 externally carries the tab 14 and internally carries the snapping band 18. The skirt portion 12.2 is designed to remain around the neck 2. To this end, the portion 12.2 is internally provided with a ledge 24 extending radially by projecting inwards from the inside surface of the skirt 12, while running all the way around the periphery of the skirt. When the stopper is assembled on the neck 2, said ledge 24 extends axially below the projection 6 and is adapted, when the stopper is lifted for the first time, to come axially into abutment against said projection.

Various embodiments are possible for the line of weakness 22. For example, said line is made up of a succession of peripheral notches that are not shown in detail in the figures, that locally weaken the skirt 12, and that define bridges between them, which bridges are obtained during molding of the stopper 1, or else by cutting the stopper after it has been removed from the mold.

Advantageously, the line of weakness 22 has breaking strength that is lower at the skirt portion $\mathbf{12}_1$ than in the remainder of the skirt around the periphery thereof. By way of example, and as clearly visible in the left portion of FIG. 3, this lower breaking strength is due to the fact that the wall thickness of the main portion of the skirt is small at the axial level of the line of weakness 22, at the front of the skirt only, in particular in the skirt portion $\mathbf{12}_1$.

Also optionally and advantageously, the line of weakness 22 may, instead of extending continuously all the way around the periphery of the skirt 12, be interrupted at the back of the stopper 1, in particular in the peripheral portion of the skirt that is diametrically opposite from the portion $\mathbf{12}_1$. In this manner, the line 22 breaking does not make it possible to disengage the skirt portion 12.1 in full relative to the skirt portion 12.2 and to the neck 2, since a link of non-breakable material then remains to interconnect the skirt portions 12.1 and 12.2, forming a tipping hinge between said skirt portions.

The stopper 1 is assembled to the container by means of a bottling head (not shown in the figures). In practice various types of head may be used, in particular heads using balls, vacuum pick-ups, cones, clamps, etc. In any event, such a head makes it possible to take hold of the stopper 1 by surrounding and clamping it externally and peripherally: the head applies holding forces T that are substantially radial relative to the axis X-X, around a holding outline C of circular shape that is centered on the central axis of the head, as indicated in FIG. 2. More precisely, the head adjusts the size of its circular holding outline C in a manner such that said outline has a radius equal to the radius $R_{16}$, i.e. such that the outline C is caused to coincide with the circular outside profile of the main portion $\mathbf{16}_1$ of the collar 16. Insofar as this collar portion $\mathbf{16}_1$ extends through more than 180° about the axis X-X and insofar as the tab 14 lies entirely within a circle centered on the axis X-X and of radius equal to $R_{16}$, the holder head and the skirt 12 are positioned coaxially, centered on the axis X-X. In addition, since the distance $R_{14}$ is equal to the radius $R_{16}$, the tab 14 forms two potential radial bearing zones for the holder head at respective ones of the two junction zones in which the main portion $\mathbf{14}_1$ of the tab meets the end portions $\mathbf{14}_2$ thereof, as indicated by the two forces T applied to respective ones of these two zones in FIG. 2. This improves the quality of the holding of the stopper 1.

Once the holder head has thus taken hold of the stopper 1 coaxially, it engages it by force onto the neck 2 along the axis X-X, until the band 18 snaps onto the edge 5

Various arrangements and variants of the stopper 1 are possible. By way of example:

rather than having the tab 14 and the collar 16 situated substantially at the same level along the axis X-X, the tab and the collar may be situated at different respective levels provided that the holder head used for taking hold of the stopper 1 is not, as a result, hindered in adjusting its circular holding outline C, at least over the circular outside profile of the collar;

the projecting tab 14 may have outside outlines other than as shown in the figures; in particular, the main portion $\mathbf{14}_1$ of the tab may have a circular outside profile, centered on the axis X-X and having its radius substantially equal to the radius $R_{16}$ of the circular main portion $\mathbf{16}_1$ of the collar 16; and/or by way of an optional arrangement, the stopper 1 considered in the figures is advantageously provided with a lip 26 that extends axially downwards from the end wall 10, in such a manner as to be centered on the axis X-X, inside the external skirt 12, so that, when the stopper is snapped onto the neck 2, the lip 26 bears in leaktight manner against the inside face of the body 4 of the neck 2; and/or in the example shown, the body 4 of the neck 2 is externally smooth between the edge 5 and the projection 6; in a variant, it may be threaded, it being understood that the thread is not used for fastening the stopper 1 onto the neck by screw-fastening, but rather that the presence of such a thread does not hinder putting the snap-shut stopper 1 into place.

The invention claimed is:

1. A stopper for a container neck, which stopper has a tubular skirt that is centered on an axis, that is suitable for surrounding the neck externally, and that is provided firstly with internal snapping means for snapping it onto the neck, these snapping means being suitable for fastening the stopper removably to the neck, by engaging with an edge of the neck, and secondly with an external manual disengagement tab making it possible to unsnap the stopper from the neck, which tab projects outwards from the skirt and runs over only a peripheral portion of the skirt;

wherein the skirt is further provided with an external collar that projects outwards from the skirt, and that runs over a peripheral portion of the skirt that is distinct from the portion associated with the tab, by being separated from said portion associated with the tab at either end around the periphery of the skirt, at least a portion of the collar that runs through greater than 180° about the axis having, in cross-section relative to the axis, a circular outside profile that is both centered on the axis and that also has a radius that is substantially equal to the maximum radial distance ($R_{14}$) between the axis and the outside profile of the tab.

2. A stopper according to claim 1, wherein the portion of the collar that has a circular outside profile extends through approximately 200° about the axis.

3. A stopper according to claim 1, wherein the portion associated with the collar is, at either end around the periphery of the skirt, separated from the portion associated with the tab by a peripheral portion of the skirt that extends through at least 5° about the axis.

4. A stopper according to claim 1, wherein the tab and the collar define the same plane of symmetry containing the axis.

5. A stopper according to claim 1, wherein the tab and the collar are situated at the same axial level along the skirt.

6. A stopper according to claim 1, wherein the tab and the collar are situated at different respective levels of the skirt along the axial direction thereof.

7. A stopper according to claim 1, wherein the snapping means comprise a snapping band that runs over the inside periphery of the skirt.

8. A stopper according to claim 7, wherein the snapping band is interrupted, around the periphery of the skirt, at least between the portion associated with the tab and the portion associated with the collar.

9. A stopper according to claim 1, wherein the stopper further includes an end wall that closes off one of the axial ends of the skirt, and wherein the portion of the skirt that connects the tab to the end wall has an outside surface that is of flatter angle than the outside surface of the portion of the skirt that connects the collar to the end wall.

10. A stopper according to claim 1, wherein the skirt is provided with a peripheral line of weakness that is adapted to be broken when the stopper is opened for the first time, and, on either side of which line along the axis, the skirt includes firstly a removable portion provided externally with the tab, and internally with the snapping means, and secondly a non-removable portion that is provided with retainer means adapted to retaining the non-removable portion around the neck when the removable skirt portion is disengaged from the neck;

and wherein the portion of the line of weakness that is situated in the portion, associated with the tab around the periphery of the skirt, presents breaking strength that is lower than the breaking strength of the remainder of the line of weakness.

11. A stopper according to claim 1, wherein the skirt is provided with a peripheral line of weakness that is adapted to be broken when the stopper is opened for the first time, and, on either side of which line along the axis, the skirt includes firstly a removable portion provided externally with the tab, and internally with the snapping means, and secondly a non-removable portion that is provided with retainer means adapted to retaining the non-removable portion around the neck when the removable skirt portion is disengaged from the neck;

and wherein the removable skirt portion and the non-removable skirt portion are interconnected by a link of non-breakable material that, around the periphery of the skirt, is situated opposite from portion associated with the tab, and that forms a tipping hinge between the removable and the nonremovable skirt portions.

* * * * *